US011603748B2

(12) United States Patent
Ellithorp

(10) Patent No.: US 11,603,748 B2
(45) Date of Patent: Mar. 14, 2023

(54) DOWNHOLE SAND SEPARATING APPARATUS WITH EROSION RESISTANT CENTRIFUGAL SEPARATOR

(71) Applicant: Brian Ellithorp, Edmond, OK (US)

(72) Inventor: Brian Ellithorp, Edmond, OK (US)

( * ) Notice: Subject to any disclaimer, the term of this patent is extended or adjusted under 35 U.S.C. 154(b) by 0 days.

(21) Appl. No.: 17/827,056

(22) Filed: May 27, 2022

(65) Prior Publication Data

US 2022/0381129 A1 Dec. 1, 2022

Related U.S. Application Data

(60) Provisional application No. 63/193,723, filed on May 27, 2021.

(51) Int. Cl.
*E21B 43/34* (2006.01)
*E21B 43/38* (2006.01)

(52) U.S. Cl.
CPC ..... *E21B 43/35* (2020.05); *E21B 43/38* (2013.01)

(58) Field of Classification Search
CPC ..... E21B 43/34; E21B 43/35; E21B 43/38
See application file for complete search history.

(56) References Cited

U.S. PATENT DOCUMENTS 5,810,081 A * 9/1998 Cobb ..... E21B 43/38 166/105.3
2016/0251951 A1* 9/2016 Stachowiak ..... E21B 43/121 166/265
2020/0263688 A1* 8/2020 Correa ..... F04B 47/12

* cited by examiner

*Primary Examiner* — David Carroll
(74) *Attorney, Agent, or Firm* — Ryan W. Dupuis; Kyle R. Satterthwaite; Ade & Company Inc.

(57) ABSTRACT

A sand separating apparatus for use with a production tubing string includes (i) a housing assembly forming an outer tubular and (ii) an inner tubular within the housing assembly to define an annular passage between the inner tubular and the housing assembly. A helical member occupies part of the annular passage below production openings in the housing assembly whereby a flow of production fluids entering from the wellbore is directed downwardly along a helical path within the annular passage as dictated by the helical member and subsequently upwardly through the inner tubular. The helical member extends radially outwardly from the inner tubular beyond a boundary surface at an outer perimeter of the annular passage to prevent formation of a gap at the tip of the helical member as it wears. A fluid passage in alignment with the helical member extends radially from inside the inner tubular to the annular passage.

20 Claims, 5 Drawing Sheets

DOWNHOLE SAND SEPARATING APPARATUS WITH EROSION RESISTANT CENTRIFUGAL SEPARATOR

This application claims the benefit under 35 U.S.C. 119(e) of U.S. provisional application Ser. No. 63/193,723, filed May 27, 2021.

FIELD OF THE INVENTION

The present invention relates to a sand separating apparatus for use within a hydrocarbon production wellbore at the bottom end of a production tubing string, and more particularly the present invention relates to a sand separating apparatus defining a helical flow path to separate sand from produced fluids using centrifugal force.

BACKGROUND

Centrifugal sand separators or desanders are commonly used in hydrocarbon production wellbores for separating solid particles such as sand from liquids and gases in the produced fluids. More particularly, as fluids and gas are ingested the multi-phase solution frequently carries with it some amount of solids, most commonly formation or frac sand. One known type of desander is mounted at the bottom of a production tubing string. As the fluids/solids flow through the separator they move downward between the main body's inner diameter and the inner tube's outer diameter. Upon reaching the bottom of the inner tube of the desander there is typically some form of spiral surrounding the outer diameter of the inner tube extending to the inner diameter wall of the main body inner diameter and there is assumed to be a very tight tolerance between the spiral's bladed tips and the inner diameter of the main body. This assembly promotes all the solids carrying multi-phase mix to follow the direction of the spirals of the vanes. It is with this flowing action that centrifugal forces act on the more dense solids or sand and they are pushed to the outer reaches of the spiral's tip and against the inner diameter wall of the main body of the sand separator.

As the flowing, solids-laden mixture reaches the bottom of the spiral, the inner tube whereabout the spiral was circling downward will concurrently have a hole for entry at its bottommost point. Upward through the inner diameter of the inner tube is the preferential direction of flow for the fluid and gas to go next upon exiting the spiral bottom, but the solids due to their density and velocity generated by the flow along the spiral, will tend to shoot and/or fall downward below the intake point of the inner tube and gravity will then make for the settling of those solids into a solids collector. The solids collector may comprise collection joints which are simply tubing joints that are plugged at the very bottom, while being attached to the bottom of the sand separator just below the spiral discharge. Solids will continue to collect in these collection joints as a pump continues to operate and enough flow rate is generated through the sand separator to create centrifugal action on the solids being carried through.

When the well is serviced for any number of reasons and the tubing assembly is pulled, the sand separator and collection joints may also be pulled at that time and all sand/solids collected in the collection joints can then be safely removed from the wellbore, the joints either emptied or replaced with new, and the assembly rerun so long as the equipment is in good working order and meets desired specification.

It is very common for the blades of the spiral and/or the main body tube inner diameter to be heavily or completely eroded through due to heavy solids production and the high velocity witnessed in typical well production, but especially those with high fluid and gas rates. The velocity profile generated through the spiral is something of particular interest as it is a certain velocity and direction of flow that must be met or exceeded to create the most desirable "slinging" of the solids to the intersection of the inner diameter of the main body and the outer diameter or tips of the blades of the spiral to create a more effective sand separating function.

That said, one to can easily see how maintaining a seal from one flight of the spiral to the next below is of utter importance to maintaining the desired flow path along the spiral and if that seal is lost due to either the tip of the spiral's blade being eroded away and/or if the seal between the blade's tip and the inner diameter of the main body is gapped due to that inner diameter being eroded away the flow will not follow along the flighting of the spiral downward as intended, proper velocity profile for the centrifugal benefit will be lost, and the separator will be rendered ineffective or non-functional from that point forward.

Further, it is common for centrifugal sand separators to erode completely through the wall of the main body along the spiral outer diameter. As that is the case and there is no way to know for sure just how quickly that wall is being eroded away, it is not uncommon for the weight of the solids collection joints to eventually cause the eroded thin and cut wall of the main body to break apart, dropping the collection joints down hole as well as the parts of the sand separator below the cut point. This is exceptionally undesirable since those dropped pieces will constitute a potentially very laborious and expensive fishing job to retrieve and being able to safely produce the well any further.

One simple solution provided by a current sand separator manufacturer is to mill the side of the separator's main body along the point in which the spiral will be located such that the internal erosion of the body's inner diameter will eat through to the milled area first, thus terminating the desired function of the separator since there would then be communication to the outer diameter through that point for fluid and gas entry, but it often will prohibit further erosion of the main body to the point it will not be cut in two and equipment will not drop downhole. Unfortunately, this is not a great solution as the wall thickness of the main body is what will prolong the lifespan of the separators function and reducing its thickness will then inevitably shorten desired life of the tool.

SUMMARY OF THE INVENTION

According to one aspect of the invention there is provided a sand separating apparatus for use with a production tubing string within a production wellbore, the apparatus comprising:

a housing assembly having an upper connector at a top end arranged for connection to the tubing string, a bottom end arranged to support an enclosed sand collector thereon, and a tubular passage extending axially through the housing assembly between the top end and the bottom end of the housing assembly;

a plug supported within the tubular passage in proximity to the top end of the housing assembly;

an inner tubular extending axially through the tubular passage between a top end of the inner tubular and a bottom end of the inner tubular in proximity to the bottom end of the housing assembly such that the inner tubular defines an inner passage extending through the inner tubular and an annular passage between the inner tubular and the housing assembly;

the inner passage of the inner tubular being in communication with the tubular passage above the plug at the top end of the inner tubular and being in communication with the annular passage at the bottom end of the inner tubular;

one or more production openings communicating through an exterior boundary of the housing assembly between the annular passage below the plug and a surrounding portion of the production wellbore;

a helical member occupying a portion of the annular passage between the inner tubular and the housing assembly;

the helical member being located below the one or more production openings whereby a flow of production fluids entering the one or more production openings from the wellbore is directed downwardly through the annular passage along a helical path dictated by the helical member and subsequently upwardly through the inner passage;

the helical member extending radially outwardly from the inner tubular beyond an outer boundary surface defined on a boundary portion of the housing assembly.

This tool will function as many other sand separators are designed to function, but will do so while maintaining a solid seal between the spiral's blade tips and the main body's interior diameter so as to increase tool lifespan by improving erosion capacity of at least the helical member.

In the preferred embodiment, the boundary portion of the housing assembly that defines the outer boundary surface of the annular passage at a location of the helical member includes a helical groove formed therein that receives an outer edge of the helical member therein.

Preferably an axial thickness of the outer edge of the helical member forms an interference fit with a corresponding axial thickness of the helical groove.

It is further preferred that the boundary portion of the housing assembly that defines the helical groove therein comprises a sleeve lining an exterior boundary wall of the housing assembly. The use of a sleeve lining the exterior boundary wall of the housing assembly also acts to increase the erosion capacity of the overall desanding apparatus.

The sleeve may be formed of a material that is harder than a material of the exterior boundary wall of the housing assembly. The sleeve may be readily replaceable relative to said exterior boundary wall of the housing assembly. For example, the sleeve is retained relative to said exterior boundary wall of the housing assembly by a threaded connection. When using a sleeve, the helical groove may extend radially fully through the sleeve such that the outer edge of the helical member is flush with an outer side surface of the sleeve.

The unique feature of this separator's design is the application of what will be called an erosion sleeve. This erosion sleeve will be made up not just about the OD of the spiral's tips, but it will be cut in such a way the spiral blades will actually thread into the erosion sleeve body from the bottom or in other words, a perfectly matching spiral pattern will be cut into the erosion sleeve and such that the tip of the spiral will be fully embedded into the sleeve and a tight tolerance fit will be created along the top and bottom of the spiral's blades, most likely with the OD of the blade tips now matching the OD of the erosion tube. This erosion sleeve with embed spiral will then be made up inside the ID of the main body's lower tube section. This lower section of the main body will be made of a heavy-wall thickness tube and further be used to extend tool functional lifespan.

The arrangement of the present invention when using an erosion sleeve with an embedded spiral allows for far more erosion to occur to the ID of the main body (now in this case—the erosion sleeve) at the contact point between the spiral's blade tips and the ID of that erosion sleeve. Since the spiral will be embedded, even as the ID of the erosion sleeve is eaten away over time the blade tips will still remain fully in contact with the ID of the erosion sleeve, thus not losing seal, desired flow path, or function for a much longer operating time. Further the erosion sleeve may have the option to be made from a much harder or treated metal such that the erosion rate may be slowed down when compared to using softer materials other may be forced to use for their main body. This sleeve not being subjected to any critical load or high amount of tension will also allow for this broader and more advantageous material selection as issues with embrittlement and possible corrosion become far less concerning since any failure of the sleeve will not result in dropping tools downhole and creating a fishing job. The erosion sleeve itself is anticipated to most always be made from materials that are of greater wall thickness than the main bodies of other sand separators are. Further, if others mill their main body OD to promote a controlled failure across their spiral's high erosion point the comparable erodible volume of this tool's erosion sleeve becomes even more prevalent as it would then be far thicker than the other sand separator company's point for failure. This trait creates a clearly distinguishable extension of lifespan when compared to other designs that work without this erosion sleeve.

According to an alternative embodiment, the boundary portion of the housing assembly that defines the helical groove therein may be an exterior boundary wall of the housing assembly.

According to a further alternative embodiment, the helical member may be formed continuously and seamlessly as a unitary structure with the outer boundary surface on the boundary portion of the housing assembly. For example, the helical member, the outer boundary surface of the annular passage at the helical member and the inner tubular at the helical member may comprise a singular casting.

The apparatus may further include a fluid passage extending radially through the inner tubular in communication between the inner passage and the annular passage in proximity to the helical member. Preferably the fluid passage is located in alignment with the helical member, between opposing top and bottom ends of the helical member in the axial direction. The fluid passage may be elongated in a circumferential direction or an axial direction of the inner tubular.

According to a second aspect of the present invention there is provided a sand separating apparatus for use with a production tubing string within a production wellbore, the apparatus comprising:

a housing assembly having an upper connector at a top end arranged for connection to the tubing string, a bottom end arranged to support an enclosed sand collector thereon, and a tubular passage extending axially through the housing assembly between the top end and the bottom end of the housing assembly;

a plug supported within the tubular passage in proximity to the top end of the housing assembly;

an inner tubular extending axially through the tubular passage between a top end of the inner tubular and a bottom end of the inner tubular in proximity to the bottom end of the housing assembly such that the inner tubular defines an inner passage extending through the inner tubular and an annular passage between the inner tubular and the housing assembly;

the inner passage of the inner tubular being in communication with the tubular passage above the plug at the top end of the inner tubular and being in communication with the annular passage at the bottom end of the inner tubular;

one or more production openings communicating through an exterior boundary of the housing assembly between the annular passage below the plug and a surrounding portion of the production wellbore;

a helical member occupying a portion of the annular passage between the inner tubular and the housing assembly;

the helical member being located below the one or more production openings whereby a flow of production fluids entering the one or more production openings from the wellbore is directed downwardly through the annular passage along a helical path dictated by the helical member and subsequently upwardly through the inner passage; and a fluid passage extending radially through the inner tubular in communication between the inner passage and the annular passage in proximity to the helical member.

Preferably the fluid passage is located in alignment with the helical member, either at the bottom end or a location spaced up from the bottom end, in proximity to a bottom end of the inner tubular. The fluid passage may be elongated in an axial direction or a circumferential direction of the inner tubular.

The fluid passage may be a small window or slot cut into the inner-tube of the spiral, for example near the point the spiral terminates upon reaching the bottom of the part. When a fluid passage is provided as described herein, instead of forcing the fluids and especially the gases to make the turn out, down, and U-turn to go into the bottom of the inner spiral assembly and flow upward the separator's top exit, gases which have coalesced around the outer diameter of the inner-tube are provided with an easy and non-disrupted flow path to make an entry into the spiral's inner tube ID and flow upward, while the solids with their inertial energy will proceed flowing along the ID of the erosion tube and discharge out the bottom of spiral when they make it there. Essentially this should allow the solids and gas phases to further segregate themselves from one another, create less of an eddy current in the flow path and allow less solids and sand particulates to flow along with the fluids and gases. The solids are thus more likely to be captured below in the solids collector joints affixed below.

BRIEF DESCRIPTION OF THE DRAWINGS

Various embodiments of the invention will now be described in conjunction with the accompanying drawings in which.

In the drawings like characters of reference indicate corresponding parts in the different figures.

DETAILED DESCRIPTION

Figure 1:
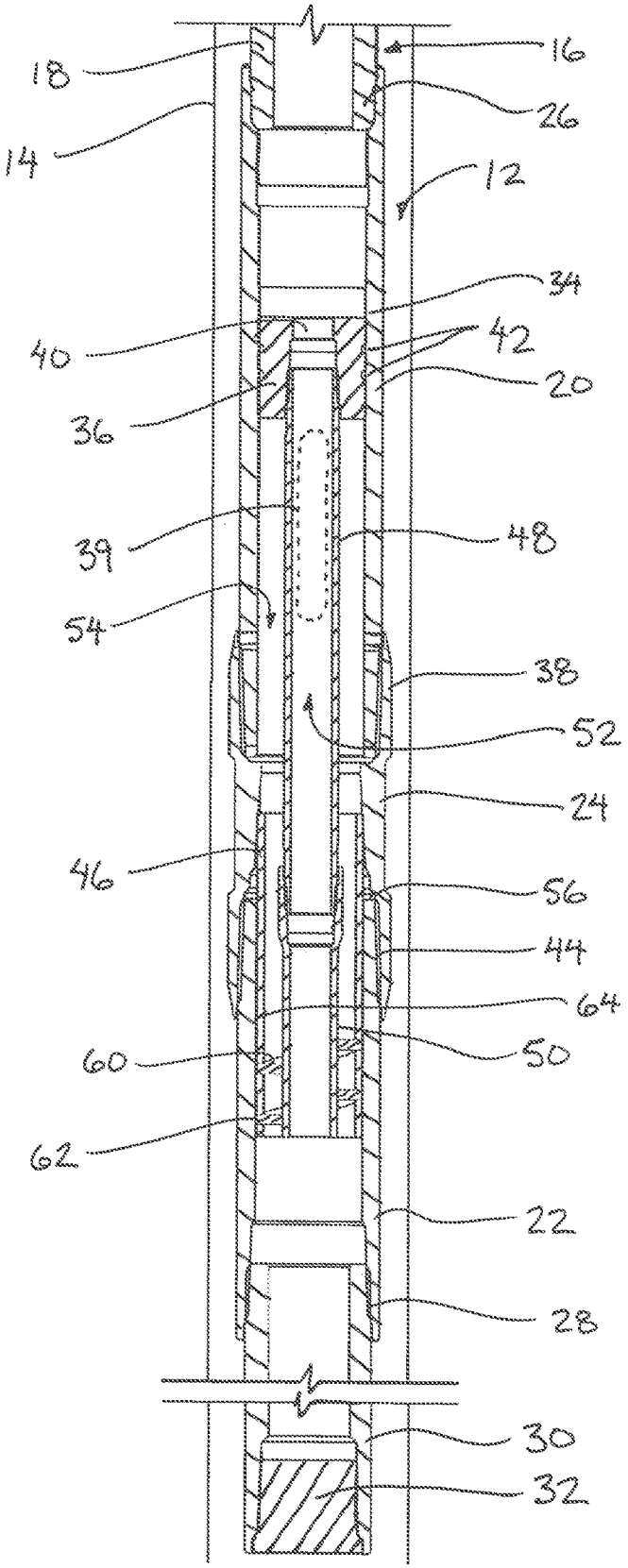
FIG. 1 is a schematic representation of the sand separating apparatus supported on a production tubing string within a hydrocarbon wellbore according to a first embodiment.
Figure 2:
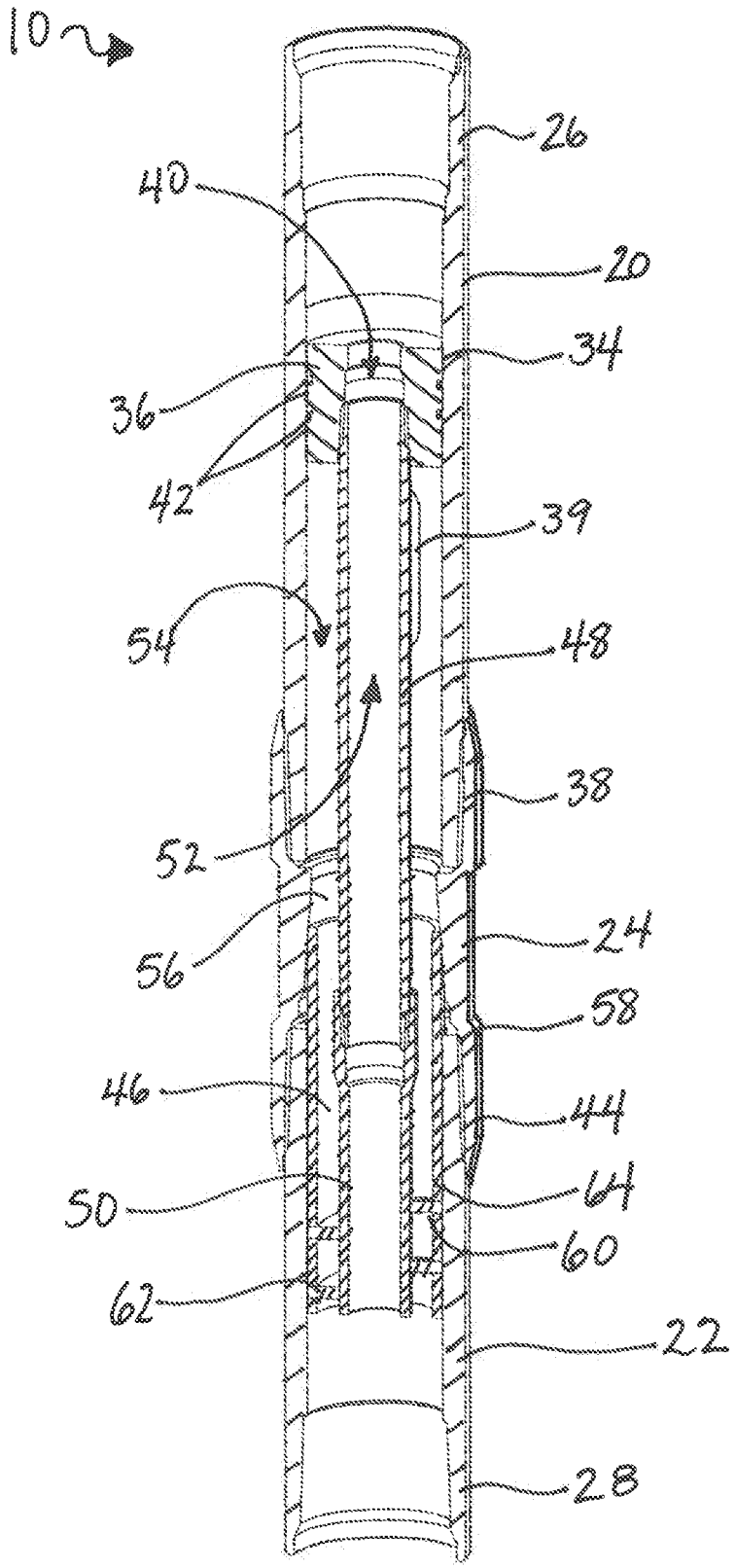
FIG. 2 is a partly sectional, perspective view of the sand separating apparatus according to the first embodiment of FIG. 1.
Figure 4:
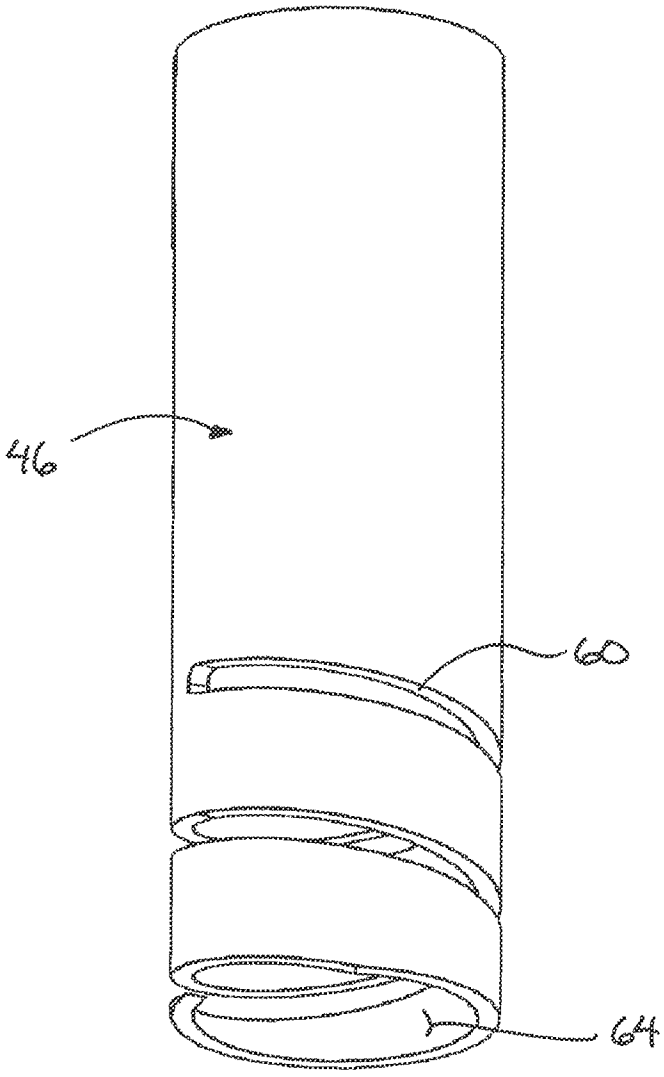
FIG. 4 is a perspective view of an erosion sleeve received with the lower housing of the housing assembly of the sand separating apparatus according to the first embodiment of FIG. 1.

Referring to the accompanying figures there is illustrated a downhole sand separating apparatus generally indicated by reference numeral 10. The apparatus 10 is particularly suited for use within a hydrocarbon production wellbore 12 lined with an outer casing 14 including perforations therein in communication with a surrounding hydrocarbon formation so that produced hydrocarbon fluids flow into the wellbore. The produced fluids can include a mixture of gases, liquids and solids, in which the solids may include dense particles such as sand.

The apparatus 10 is typically supported on a production tubing string 16 supported within the outer casing 14 of the wellbore. The tubing string may comprise jointed tubing or a coiled tubing string extending downwardly into the wellbore from a wellhead at surface from which the tubing string is suspended in the usual manner. In the illustrated example, the production tubing string includes a downhole submersible pump 18 for lifting produced fluids up the tubing string for collection at the surface. The submersible pump 18 is connected in series with the tubing string in proximity to a bottom end of the tubing string.

According to the illustrated embodiment, the sand separating apparatus 10 is connected in series with the tubing string below the downhole pump 18 at the bottom end of the tubing string for separating out some of the denser solids such as sand before the produced fluids enter the pump to be pumped up to surface. The apparatus 10 generally includes a housing assembly that is connected in line with the tubing string 16. According to the illustrated embodiment, the housing assembly includes an upper housing 20 forming an upper portion of the apparatus, a lower housing 22 forming a lower portion of the apparatus, and a housing connector 24 forming a connection between the upper housing above and the lower housing below at an intermediate location along the apparatus. Each section of the housing assembly is a tubular body open at opposing top and bottom ends for communication of a tubular passage longitudinally through the housing assembly. Both ends of each portion of the housing assembly form a suitable threaded connection for joining to adjacent components of the housing assembly and/or the tubing string.

When the various components of the housing assembly are joined together, a top end of the upper housing 20 defines an upper connector 26 at a top end of the housing assembly. The upper connector 26 is an internally threaded collar arranged to be joined by threaded connection to the externally threaded male end at the bottom of the tubing string below the pump 18. Likewise, a bottom end of the lower housing 22 defines a lower connector 28 at the bottom end of the housing assembly. The lower connector 28 is an internally threaded collar arranged to be joined by threaded connection to the externally threaded male end at the top end of a series of one or more collector joints 30 below the apparatus. The overall connected components of the housing assembly define a tubular passage extending axially along a full length of the housing assembly between the upper connector 26 at the top end and the lower connector 28 at the bottom end.

The one or more collector joints 30 collectively define a sand collector supported below the apparatus 10. Each collector joint comprises a tubular housing having open top and bottom ends and a through passage communicating therethrough between the opposing ends. Threaded connections at opposing ends of each collector joint 30 allow multiple joints to be connected and joined in series with one another at the bottom end of the tubing string. A lowermost one of the collector joints 30 includes a lower plug 32 threaded therein which fully encloses the bottom end of the series of collector joints 30. In this manner the series of collector joints 30 define an enclosed volume suitable for collection and storage of separated solids therein during operation of the sand separating apparatus above. When the tubing string is periodically pulled up to surface for servicing, the one or more collector joints 30 can be removed and/or the lower plug 32 can be removed to allow removal and emptying of collected solid particles within the sand collector, followed by reassembly and reinsertion of the tubing string into the wellbore for continued use of the sand separating apparatus. More collector joints 30 can be connected in series with one another to increase the enclosed storage volume within the joints and therefore increase the capacity to collect sand between servicing operations of the tubing string if required.

The upper housing 20 is a straight section of tubular body locating the upper connector 26 at the top end thereof. A counterbore 34, that is reduced in diameter relative to the upper connector 26, extends downwardly through the upper housing 20 from the upper connector 26 so that an upper plug 36 can be inserted into the top end of the upper housing.

In the illustrated embodiment, a bottom end of the upper housing is externally threaded to form a male connector that forms a threaded connection with the internally threaded collar forming an upper connector 38 at the top end of the connector housing 24 as described in further detail below.

The upper housing includes a pair of production openings 39 located in diametrically opposed boundary walls of the housing at an intermediate location spaced longitudinally inward from both opposing ends of the housing. Each of the production openings is elongated in the axial direction and provides open communication from the interior passage of the housing assembly to the surrounding space between the tubing string and the outer casing. In this manner, produced fluids entering the wellbore from the hydrocarbon formation are in turn communicated into the interior of the housing assembly through the production openings 39 in the upper housing.

The upper plug 36 is a cylindrical body received within the counterbore 34 and locating a central passage 40 communicating axially therethrough as described in further detail below. The upper plug 36 is thus generally annular in shape. A set of annular perimeter seals 42 are received within corresponding grooves in the outer surface of the upper plug to provide a fluid tight seal between the upper plug 36 and the surrounding counterbore 34 of the upper housing.

The lower housing 22 is a straight section of tubular body locating the lower connector 28 at the bottom end thereof. A top end of the lower housing is externally threaded to form a male connector that forms a threaded connection with an internally threaded collar forming a lower connector 44 at the bottom end of the connector housing 24 as described in further detail below.

In the illustrated embodiment, an erosion sleeve 46 lines the inner surface of the lower housing 22 as described in further detail below.

The apparatus 10 further includes an inner tubular member that is suspended within the tubular passage extending axially through the housing assembly. In the illustrated embodiment the inner tubular includes an upper section 48 primarily located within the upper housing 20 and a lower section 50 primarily located within the lower housing 22. The top end of the upper section 48 is externally threaded, forming a male connector for threaded connection into the central passage 40 within the upper plug 36. The opposing bottom end of the upper section 48 is also externally threaded, forming a male connector for threaded connection into a corresponding internally threaded collar formed at the top end of the lower section 50 therebelow. The lower section includes the internally threaded collar at the top end thereof and extends as a straight tube below the lower section such that an internal diameter of the lower section is approximately equal to the internal diameter of the upper section. The bottom end of the lower section 50 is an open end that remains in open communication with the tubular passage within the housing assembly therebelow.

When suspended within the housing assembly, the inner tubular effectively defines (i) an inner passage 52 of the apparatus which extends axially along a full-length of the inner tubular between an open top end and an open bottom end thereof, and (ii) an annular passage 54 surrounding the inner tubular in the space between the inner tubular and the surrounding housing assembly so as to be annular in shape while extending axially along a full length of the inner tubular. In the mounted position, the inner passage 52 within the interior of the inner tubular communicates through the central passage in the upper plug 36 for open communication with the interior of the tubing string extending above the apparatus. The bottom ends of both the inner passage 52 and the annular passage 54 are in open communication with the interior of the housing assembly therebelow such that the bottom ends of the inner and annular passages openly communicate with one another at the bottom end of the inner tubular.

The connector housing 24 includes (i) the upper connector 38 at the top end for connection to the upper housing 20 and (ii) the lower connector 44 at the bottom end for connection to the lower housing 22 as described above. The connector housing 24 further includes an annular inner collar 56 integral with the body of the connector housing and protruding radially inward from an inner surface of the connector housing immediately below the upper connector 38 to form an upper shoulder at the top side thereof against which the bottom end of the upper housing 20 can be abutted in the assembled configuration. An inner diameter of the inner collar 56 may be approximately equal to the inner diameter of the upper housing.

A counterbore 58 which is internally threaded is formed within the connector housing from the bottom end of the housing above the lower connector 44. The internal threading on the counterbore of reduced diameter relative to the lower connector defines an intermediate connector above the lower connector but below the inner collar 56. In this manner, when the lower housing 22 of the housing assembly is threaded into the lower connector 44, the erosion sleeve 46 that lines the lower housing can protrude upwardly above the top end of the lower housing so that an externally threaded connector at the top end of the erosion sleeve can be threaded into the internal threading of the counterbore 58 forming the intermediate connector of the connector housing.

The erosion sleeve 46 is a straight tubular sleeve having an outer diameter closely matching the inner diameter of the lower housing while spanning a majority of the length of the lower housing. The erosion sleeve is made of a harder material which is more wear resistant than the material forming the various sections of the housing assembly. In this manner the upper and lower housings of the housing assembly can be formed of a material having a greater tensile strength for carrying the weight of the apparatus and the sand collector therebelow while the erosion sleeve is relied on primarily for wear resistance.

The erosion sleeve 46 includes a helical groove 60 formed therein adjacent a bottom end of the sleeve 46 that corresponds approximately to the elevation of the lower end portion of the lower section 50 of the inner tubular. The helical groove is open to the inner surface of the sleeve while penetrating the full radial thickness of the sleeve.

The lower section 50 of the inner tubular includes a corresponding helical member 62 formed thereon. The helical member is a flange protruding radially outward from the inner tubular along a helical path forming two complete turns about the inner tubular. The helical member has a uniform thickness in the axial direction along the length and radial width thereof. The helical member spans a radial distance to an outer edge of the helical member corresponding to the radial dimension of the annular passage between the outer diameter of the inner tubular and the inner diameter of the lower housing 22.

The helical member 62 is mated with the helical groove 60 such that the helical member protrudes radially outward across the full thickness of the erosion sleeve. The pitch and length of the helical member matches the pitch and length of the helical groove. The thickness in the axial direction of the helical member is approximately equal to or slightly greater than the axial thickness of the groove to receive the outer edge of the helical member 62 within the helical groove 60 along the full length thereof by interference fit in the axial direction. The helical member thus forms a tight seal with the surrounding erosion sleeve along the full length of the helical flow path defined by the helical member 62. The helical member is a unitary body which is seamless and continuous with the lower section 50 of the inner tubular. The helical flow path defined by the helical member within the annular passage of the apparatus communicates openly with the annular passage of the upper housing 20 thereabove that is in open communication with the production openings 39 and communicates openly with the tubular passage within the housing assembly therebelow.

In the assembled configuration, an overall flow path is defined to allow produced fluids to enter the tubular housing through the production openings 39 in the upper housing 20 so that the produced fluids entering the annular passage of the upper housing are blocked from upward flow by the upper plug but communicate openly with the helical flow path of the helical member 62 therebelow. As the produced fluids flow downwardly through the helical flow path centrifugal forces urge denser solid particles including sand and the like to flow along an outer boundary surface 64 of the helical flow path. Upon exiting the bottom of the helical flow path, denser sand particles tend to settle by gravity along the outer boundary surface of the housing assembly and the sand collector below while the lighter gasses and liquids nearer to the inner tubular are more likely to be drawn upwardly through the inner passage of the inner tubular.

Figure 3:
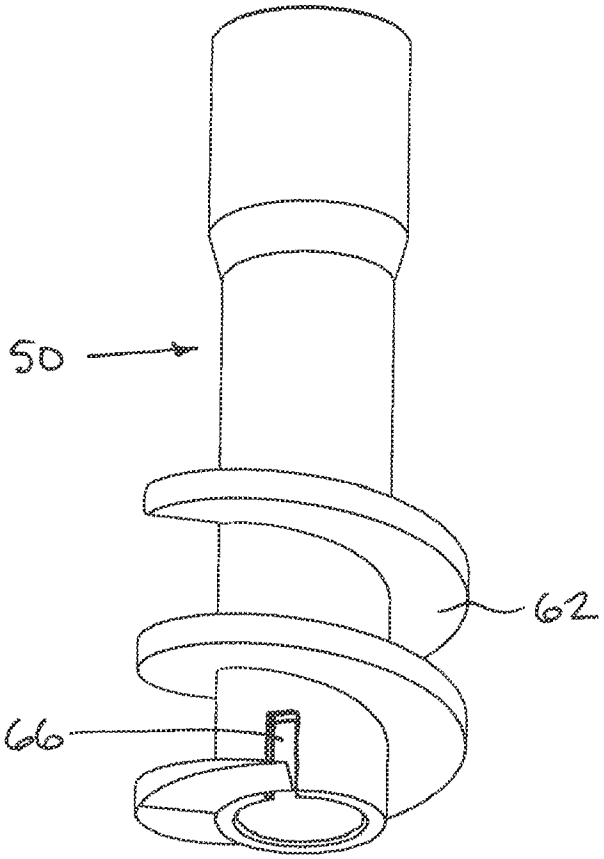
FIG. 3 is a perspective view of a lower section of the internal tubular of the sand separating apparatus according to the first embodiment of FIG. 1.

To assist lighter fluid in entering the bottom end of the inner passage more readily, an additional fluid passage 66 is provided as an open port communicating radially through the wall of the lower section 50 of the inner tubular in axial alignment with the helical member between the top and bottom ends of the helical member. The fluid passage 66 in the first embodiment of FIG. 3 is elongated in an axial direction and is located directly adjacent to the bottom end of the helical member and the bottom end of the inner tubular. As the produced fluids follow the helical path defined by the helical member 62, the lighter gases and liquids within the produced fluids tend to be located closer to the inner tubular due to centrifugal forces as noted above such that the lighter gases and liquids are more readily drawn into the fluid passage 66 and into the inner passage extending up the inner tubular. In this manner gases and lighter liquids are more easily directed into the inner tubular away from the turbulence of sand and denser solid particles at the outer boundary.

According to the first illustrated embodiment, the helical member and the lower section 50 of the inner tubular are formed as a unitary single body of material. The groove in this instance is formed in the erosion sleeve 46 such that it is the inner cylindrical surface of the erosion sleeve that defines an outer boundary surface 64 of the helical flow path while the erosion sleeve itself forms a boundary portion of the overall housing assembly that locates the helical flow path therein. Due to the groove in the erosion sleeve, the material of the body forming the helical member 62 protrudes radially outward to beyond the outer boundary surface 64.

The apparatus 10 is assembled by threading the helical member into the helical groove of the erosion sleeve separate from the connection of the upper and lower housings onto the housing connector 24. The upper plug 36 is supported within the upper housing with the upper section 48 of the inner tubular suspended therefrom. The assembled lower section 50 of the inner tubular and surrounding erosion sleeve 46 can then be inserted upwardly through the bottom end of the lower housing 22 for simultaneously threading the erosion sleeve into the intermediate connector 58 on the connector housing 24 and threading the internally threaded collar at the upper end of the lower section 50 of the inner tubular onto the externally threaded bottom end of the upper section 48. The collector joints and lower plug 32 can then be supported on the bottom end of the apparatus to complete the assembly of the apparatus before insertion on the bottom end of a tubing string into a wellbore. Operation of the pump will draw produced fluids into the upper housing 20 along the flow path prescribed above to separate sand for collection in the collector joints 30 while separated gases and liquids flow up the inner passage of the inner tubular.

Figure 5:
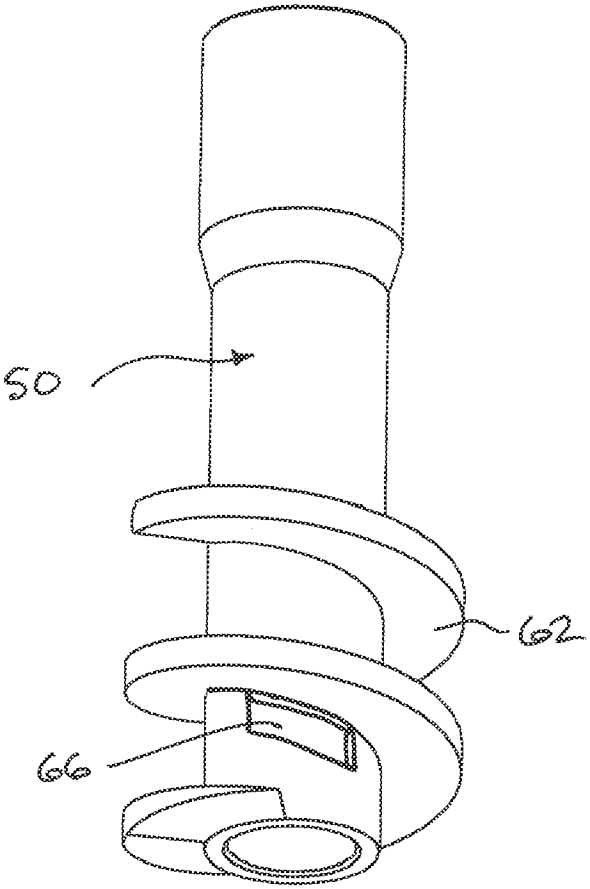
FIG. 5 is a perspective view of a second embodiment of the lower section of the internal tubular of the sand separating apparatus.

In one alternative embodiment of the lower section 50 of the inner tubular, as shown in FIG. 5, the additional fluid passage 66 that communicates radially through the wall of the inner tubular between the inner passage in the inner tubular and the surrounding annular passage is instead located at a location spaced upwardly from the bottom end of the helical member at an intermediate location along the helical member. The passage 66 may also be located immediately below a section of the helical member so as to be spaced above a subsequent section of the helical member therebelow to optimally shield the passage 66 from any sand falling to the bottom of the fluid flow. The passage 66 in this instance can also be elongated in a circumferential direction. As the produced fluids follow the helical path defined by the helical member 62, the lighter gases and liquids within the produced fluids tend to be located closer to the inner tubular and close to the underside of the helical member due to centrifugal forces and gravity such that the lighter gases and liquids may be more readily drawn into the fluid passage 66 according to FIG. 5.

Figure 6:
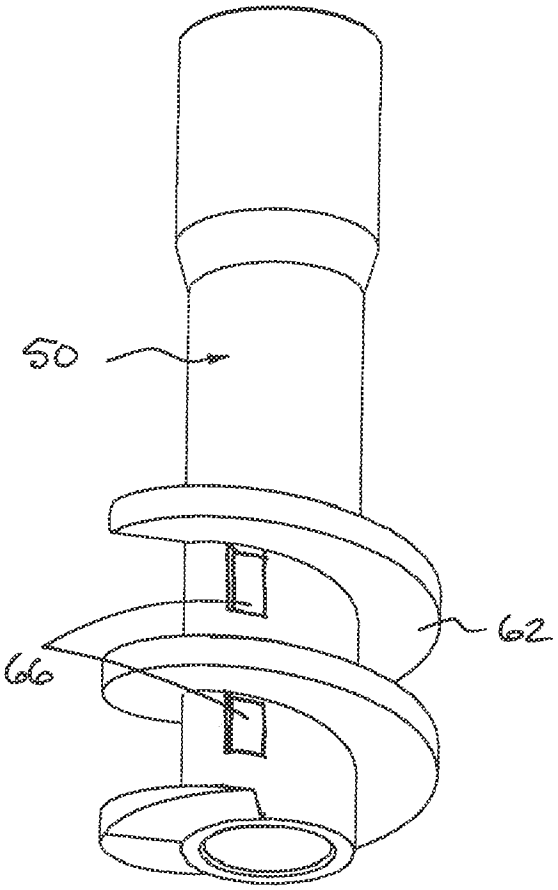
FIG. 6 is a perspective view of a third embodiment of the lower section of the internal tubular of the sand separating apparatus.

In a further alternative embodiment of the lower section 50 of the inner tubular, as shown in FIG. 6, the additional fluid passage 66 that communicates radially through the wall of the inner tubular between the inner passage in the inner tubular and the surrounding annular passage instead comprises more than one aperture or slot in alignment with different sections of the helical path at different elevations. Each passage 66 in this instance may again be located directly below the underside of a respective section of the helical member, including an uppermost passage 66 directly below the top end portion of the helical member. Again, as the produced fluids follow the helical path defined by the helical member 62, the lighter gases and liquids within the produced fluids tend to be located closer to the inner tubular and close to the underside of the helical member due to centrifugal forces and gravity such that the lighter gases and liquids may be more readily drawn into the fluid passages 66 according to FIG. 6.

Figure 8:
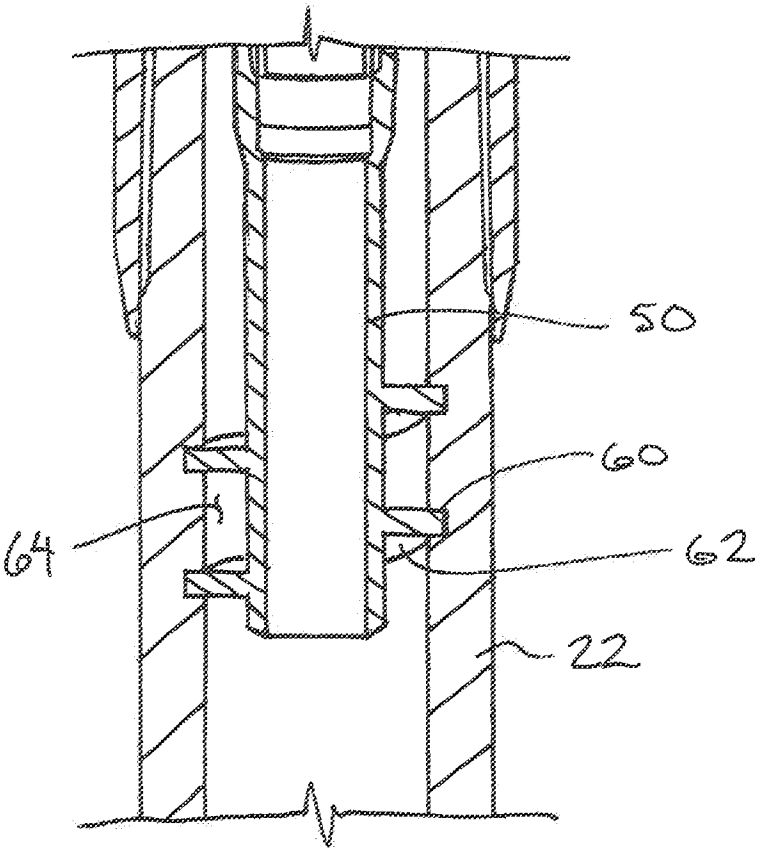
FIG. 8 is a perspective view of a fifth embodiment of the lower section of the internal tubular of the sand separating apparatus.

In an alternative embodiment of the overall apparatus 10, as shown in FIG. 8, no erosion sleeve 46 is provided such that the helical groove 60 is instead formed into the inner surface of the exterior boundary wall of the lower housing 22 directly. In this instance the inner surface of the exterior boundary wall of the lower housing defines the outer boundary surface 64 of the helical flow path while the exterior wall of the housing assembly itself defines a boundary portion upon which the outer boundary surface is defined. By forming a groove in the boundary wall of the housing and sizing the helical member 62 such that the outer edge of the helical member is received within the helical groove embedded partway into the boundary wall of the housing, a tight seal between the helical member 62 and the surrounding boundary portion of the closing remains even as the inner surface of the boundary portion of the housing begins to wear away slightly.

Figure 7:
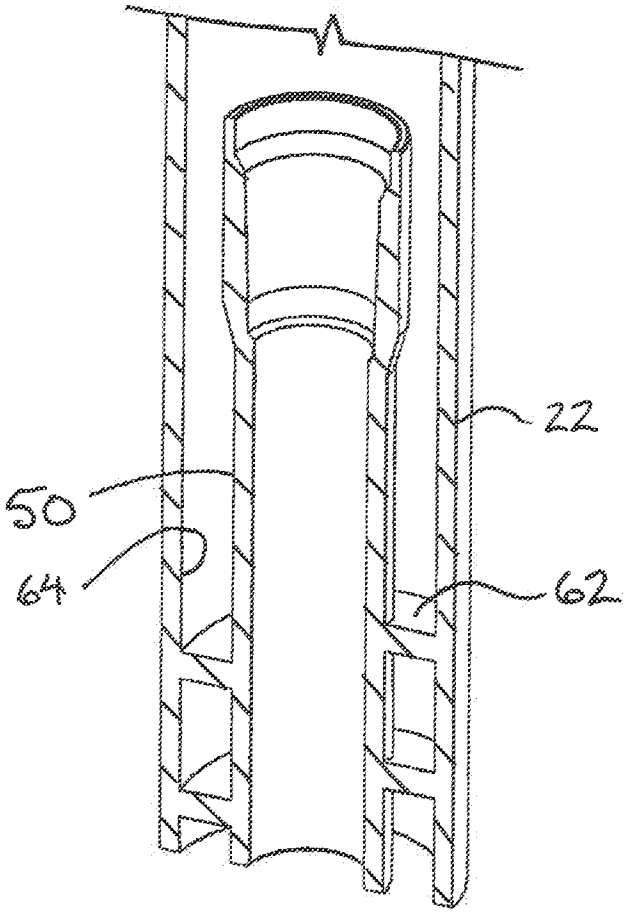
FIG. 7 is a perspective view of a fourth embodiment of the lower section of the internal tubular of the sand separating apparatus.

In yet a further embodiment, as shown in FIG. 7, (i) the lower housing 22 forming the boundary portion of the housing that defines the outer boundary surface 64 of the helical flow path thereon, (ii) the helical member 62, and (iii) the lower section 50 of the inner tubular may be formed as a single casting comprising a single body of material which is continuous, seamless and unitary throughout. In this instance, the portion of the casting forming the lower housing 22 comprises the boundary portion of the housing assembly that defines the outer boundary surface 64 of the helical flow path thereon. As in previous embodiments, the body of material forming the helical member again protrudes integrally radially outward beyond the outer boundary surface 64 by extending as a unitary body into the surrounding lower housing 22.

In yet a further embodiment, (i) the erosion sleeve 46 forming the boundary portion of the housing that defines the outer boundary surface of the helical flow path thereon, (ii) the helical member 62, and (iii) the lower section 50 of the inner tubular may be formed as a single casting comprising a single body of material which is continuous, seamless and unitary throughout. The resulting casting would appear similarly to FIG. 7, but with the outer boundary being defined by the erosion sleeve 46 instead of the lower housing 22 according to the embodiment of FIG. 7. The erosion sleeve is then inserted into the lower housing 22 in the same manner as the first embodiment. In this instance, the portion of the casting forming the erosion sleeve comprises the boundary portion of the housing assembly that defines the outer boundary surface 64 of the helical flow path thereon. As in previous embodiments, the body of material forming the helical member again protrudes integrally radially outward beyond the outer boundary surface 64 by extending as a unitary body into the surrounding lower housing 22.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A sand separating apparatus for use with a production tubing string within a production wellbore, the apparatus comprising:

a housing assembly having an upper connector at a top end arranged for connection to the tubing string, a bottom end arranged to support an enclosed sand collector thereon, and a tubular passage extending axially through the housing assembly between the top end and the bottom end of the housing assembly;

a plug supported within the tubular passage in proximity to the top end of the housing assembly;

an inner tubular extending axially through the tubular passage between a top end of the inner tubular and a bottom end of the inner tubular in proximity to the bottom end of the housing assembly such that the inner tubular defines an inner passage extending through the inner tubular and an annular passage between the inner tubular and the housing assembly;

the inner passage of the inner tubular being in communication with the tubular passage above the plug at the top end of the inner tubular and being in communication with the annular passage at the bottom end of the inner tubular;

one or more production openings communicating through an exterior boundary of the housing assembly between the annular passage below the plug and a surrounding portion of the production wellbore;

a helical member occupying a portion of the annular passage between the inner tubular and the housing assembly;

the helical member being located below the one or more production openings whereby a flow of production fluids entering the one or more production openings from the wellbore is directed downwardly through the annular passage along a helical path dictated by the helical member and subsequently upwardly through the inner passage;

the helical member extending radially outwardly from the inner tubular beyond an outer boundary surface defined on a boundary portion of the housing assembly.

2. The apparatus according to claim 1 wherein the boundary portion of the housing assembly that defines the outer boundary surface of the annular passage at a location of the helical member includes a helical groove formed therein that receives an outer edge of the helical member therein.

3. The apparatus according to claim 2 wherein the boundary portion of the housing assembly that defines the helical groove therein is an exterior boundary wall of the housing assembly.

4. The apparatus according to claim 2 wherein the boundary portion of the housing assembly that defines the helical groove therein comprises a sleeve lining an exterior boundary wall of the housing assembly.

5. The apparatus according to claim 4 wherein the sleeve is formed of a material that is harder than a material of the exterior boundary wall of the housing assembly.

6. The apparatus according to claim 4 wherein the sleeve is readily replaceable relative to said exterior boundary wall of the housing assembly.

7. The apparatus according to claim 4 wherein the sleeve is retained relative to said exterior boundary wall of the housing assembly by a threaded connection.

8. The apparatus according to claim 4 wherein the helical groove extends radially fully through the sleeve such that the outer edge of the helical member is flush with an outer side surface of the sleeve.

9. The apparatus according to claim 2 wherein an axial thickness of the outer edge of the helical member forms an interference fit with a corresponding axial thickness of the helical groove.

10. The apparatus according to claim 1 wherein the helical member is formed continuously and seamlessly as a unitary structure with the outer boundary surface on the boundary portion of the housing assembly.

11. The apparatus according to claim 10 wherein the helical member, the outer boundary surface of the annular passage at the helical member and the inner tubular at the helical member comprise a singular casting.

12. The apparatus according to claim 1 further comprising a fluid passage extending radially through the inner tubular in communication between the inner passage and the annular passage in proximity to the helical member.

13. The apparatus according to claim 12 wherein the fluid passage is located in alignment with the helical member.

14. The apparatus according to claim 12 wherein the fluid passage is elongated in a circumferential direction of the inner tubular.

15. The apparatus according to claim 12 wherein the fluid passage is elongated in an axial direction of the inner tubular.

16. A sand separating apparatus for use with a production tubing string within a production wellbore, the apparatus comprising:

a housing assembly having an upper connector at a top end arranged for connection to the tubing string, a bottom end arranged to support an enclosed sand collector thereon, and a tubular passage extending axially through the housing assembly between the top end and the bottom end of the housing assembly;

a plug supported within the tubular passage in proximity to the top end of the housing assembly;

an inner tubular extending axially through the tubular passage between a top end of the inner tubular and a bottom end of the inner tubular in proximity to the bottom end of the housing assembly such that the inner tubular defines an inner passage extending through the inner tubular and an annular passage between the inner tubular and the housing assembly;

the inner passage of the inner tubular being in communication with the tubular passage above the plug at the top end of the inner tubular and being in communication with the annular passage at the bottom end of the inner tubular;

one or more production openings communicating through an exterior boundary of the housing assembly between the annular passage below the plug and a surrounding portion of the production wellbore;

a helical member occupying a portion of the annular passage between the inner tubular and the housing assembly;

the helical member being located below the one or more production openings whereby a flow of production fluids entering the one or more production openings from the wellbore is directed downwardly through the annular passage along a helical path dictated by the helical member and subsequently upwardly through the inner passage; and a fluid passage extending radially through the inner tubular in communication between the inner passage and the annular passage in proximity to the helical member.

17. The apparatus according to claim 16 wherein the fluid passage is located in proximity to a bottom end of the helical member.

18. The apparatus according to claim 16 wherein the fluid passage is located in axial alignment with the helical member between a top end and a bottom end of the helical member.

19. The apparatus according to claim 16 wherein the fluid passage is elongated in a circumferential direction of the inner tubular.

20. The apparatus according to claim 16 wherein the fluid passage is elongated in an axial direction of the inner tubular.

* * * * *